US006131975A

United States Patent [19]

Simpson

[11] Patent Number: 6,131,975

[45] Date of Patent: Oct. 17, 2000

[54] SURFACE PROTECTOR

[75] Inventor: Lloyd Simpson, Pittsburgh, Pa.

[73] Assignee: Armstrong/Kover Kwick, Inc., McKees Rocks, Pa.

[21] Appl. No.: 09/232,798

[22] Filed: Jan. 15, 1999

[51] Int. Cl.[7] ..... B66C 1/22

[52] U.S. Cl. ..... 294/67.2; 24/442

[58] Field of Search ..... 294/67.2, 67.22, 294/74, 901, 902, 171, 103.2; 24/442, 446–450; 248/205.2; 293/155

[56] References Cited

U.S. PATENT DOCUMENTS

| | | | |
|---|---|---|---|
| 1,621,650 | 3/1927 | Angel | 294/67.22 |
| 2,510,674 | 6/1950 | Andersen | 294/74 |
| 3,291,519 | 12/1966 | Burke | 294/67 |
| 3,368,811 | 2/1968 | Finney | 294/25 |
| 3,370,818 | 2/1968 | Perr | 24/442 |
| 4,290,174 | 9/1981 | Kalleberg | 24/448 |
| 4,641,876 | 2/1987 | Kiser et al. | 294/86.4 |
| 4,717,188 | 1/1988 | Johnston | 294/67.2 |
| 4,784,419 | 11/1988 | Jensen et al. | 294/67.2 |
| 4,919,465 | 4/1990 | Gembarosky et al. | 294/67.2 |
| 5,101,539 | 4/1992 | Kennedy et al. | 24/442 |
| 5,205,599 | 4/1993 | Wassmer et al. | 294/67.33 |
| 5,636,888 | 6/1997 | Kiser et al. | 294/82.19 |
| 5,688,010 | 11/1997 | Moyer | 294/67.2 |

FOREIGN PATENT DOCUMENTS

| | | | |
|---|---|---|---|
| 1438721 | 6/1976 | United Kingdom | 24/450 |

*Primary Examiner*—Dean J. Kramer
*Attorney, Agent, or Firm*—Webb Ziesenheim Logsdon Orkin & Hanson, P.C.

[57] ABSTRACT

A surface protector for use with C hooks and other material handling equipment having a plastic protective layer removably attached to an adhering layer fixed to the equipment. A connecting layer made from a sheet of material having loops extending from one side is attached to the protective layer and releasably connects to hooks covering the adhering layer. The protective layer may be repeatedly replaced when worn.

13 Claims, 2 Drawing Sheets

SURFACE PROTECTOR

BACKGROUND OF THE INVENTION

1. Field of the Invention

The present invention relates to a surface protector for protecting materials handled by a material handling system, in particular, for protecting steel coils handled by C hooks.

2. Description of the Prior Art

The steel industry commonly uses so called C hooks for lifting and transporting steel coils. The hook is typically formed from steel and is made in a C-shaped configuration having a vertical portion and two spaced apart horizontal legs. The upper horizontal leg is connected to a crane or the like for moving the C hook about in a steel mill. A free end or nose of the lower horizontal leg is typically inserted into a central opening in a coil of steel so that the coil may be transported through the steel mill. Unfortunately, steel coils occasionally are damaged by the C hook when the lower horizontal leg is inserted into the coil opening with excessive force causing the vertical portion to impact the side of the steel coil or causing the nose of the lower leg to impact the side or the inside surface of the coil when inserted therethrough.

One system for protecting steel coils from damage by C hooks is disclosed in U.S. Pat. No. 4,717,188. In such a system, a bumper including a polypropylene layer or other plastic material is bolted to the vertical portion of the C hook. The bolts are typically countersunk into the polypropylene layer. Over time, the polypropylene layer becomes worn away from repeated use and must be replaced by removing the bolts and the worn polypropylene layer and installing a new polypropylene layer. Occasionally, the polypropylene layer becomes worn away so much that the countersunk bolts are exposed which themselves scratch and damage the steel coils. To prolong the life of the polypropylene layer bolted to the vertical portion, the layer is often made up to 1½ inch thick to provide sufficient amount of material for wearing until just before the countersunk bolts become exposed. The portion of the polypropylene layer through which the bolts extend cannot be used as a bumper since the bolts would damage the steel. Thus, there is significant excess polypropylene used in the bumper.

Another solution avoiding the use of bolts through the bumper has been to apply plastic such as polyurethane directly to a C hook. To fix the plastic to the C hook, the hook must be removed from the steel mill and polyurethane is then directly poured onto the hook. This is a costly procedure particularly in terms of the downtime for the mill during the removal and coating of the C hook with polyurethane.

Other material handling systems also require use of protective devices or bumpers to prevent the materials being handled from damage by the material handling components. For material handling components over which materials are slid, it is common to tape a layer of cardboard to the surface of the material handling component. One problem with this system is that the cardboard and the tape are easily ripped and torn from the material handling component thereby exposing the material to be handled to the material handling component and subjecting the material to damage. A more costly alternative is to use a layer of felt glued to the material handling system. Once the felt becomes partially worn away, the layer of felt is peeled off of the material handling surface and a new layer of felt is adhered thereto. Such a felt system requires the use of adhesives which often are difficult to remove from the material handling surface or result in pieces of felt becoming stuck thereto.

Accordingly, a need remains for a system for protecting surfaces from material handling components which utilizes a minimal amount of material and is readily replaceable on site.

SUMMARY OF THE INVENTION

The present invention is a surface protection system for covering a component with a protective element to prevent damage between a material and the component and includes (i) an adhering layer having a first surface and a second surface, the first surface configured to be fixed to a component, (ii) a connecting layer having a first surface and second surface, the connecting layer first surface being removably attached to the adhering layer second surface, and (iii) a protective layer having a first surface and a second surface. The protective layer first surface is fixed to the connecting layer second surface, such that the protective layer maintains the component in spaced apart relationship from a material whereby the material is not damaged by the component during handling of the material by the component.

The adhering layer second surface preferably includes a plurality of hooks. The connecting layer is removably attached to the adhering layer second surface via the hooks. The protective layer preferably is made from a plastic such as polyurethane or an ultrahigh molecular weight (UHMW) polymer. When the plastic is an UHMW polymer, the system preferably further includes a joining layer fixed between the connecting layer and the protective layer. The joining layer may be formed from rubber or fabric. The contacting layer first surface preferably includes a plurality of loops engageable by the hooks of the adhering layer second surface.

The system may be made so that the protective layer is planar or U-shaped or in other configurations. The U-shaped protective layer includes a planar portion with a pair of integral leg portions positioned on opposing sides of the planar portion.

The present invention further includes a method of protecting a surface subject to damage from a material handling component. The steps of the method including providing a material handling component, fixing a first surface of an adhering layer to the material handling component and removably attaching a first surface of a connecting layer to a second surface of the adhering layer. A second surface of the connecting layer is fixed to a protective layer such that the protective layer maintains material to be handled and the material handling component is in spaced apart relationship and protects the material from damage by the component.

The step of fixing an adhering layer first surface preferably includes disposing an adhesive layer between the material handling component and the adhering layer first surface. The adhering layer second surface preferably includes a plurality of hooks such that the step of removably attaching the connecting layer first surface includes releasably engaging the hooks of the adhering layer second surface with the connecting layer. The connecting layer first surface preferably includes a plurality of loops releasably engageable with the hooks of the adhering layer second surface and the protective layer preferably is made from a plastic.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
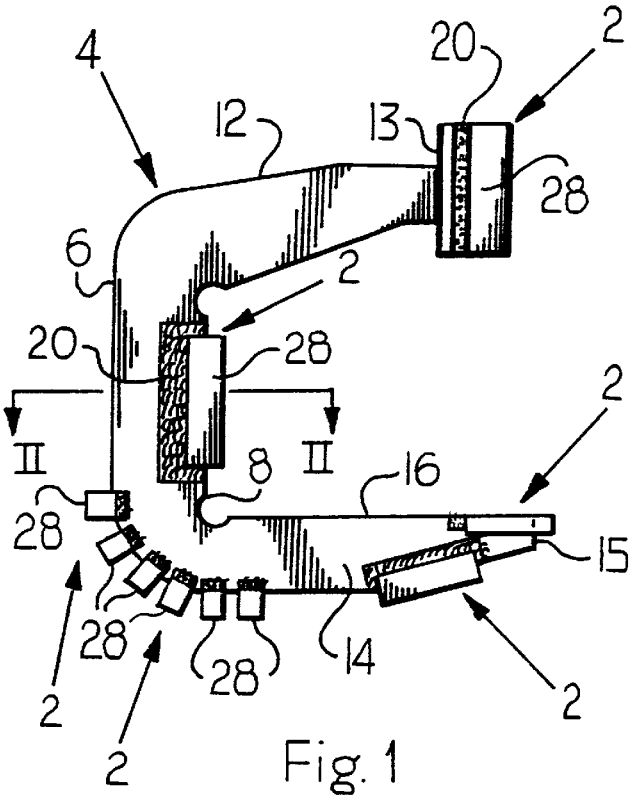
FIG. 1 is a side view of a typical "C hook" having one embodiment of the protection system made in accordance with the present invention attached thereto.

For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
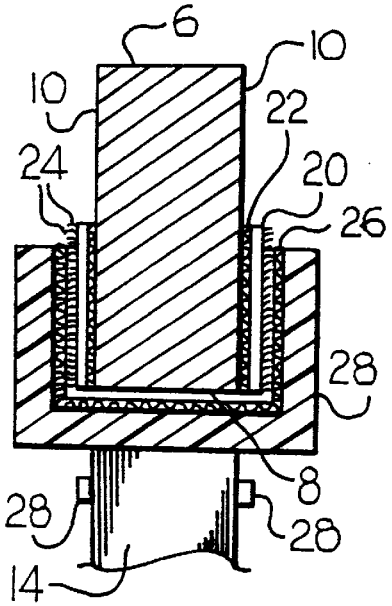
FIG. 2 is a partial cross-sectional view taken along lines II—II of FIG. 1.

The protection system 2 of the present invention is shown in FIGS. 1 and 2 attached to a C hook 4 for transporting coiled strips of steel. A conventional C hook 4 includes a vertical portion 6 having a front surface 8 and two opposing side surfaces 10 connected to each of a horizontal upper leg 12 (bearing a counterweight 13) and a horizontal lower leg 14. The C hook 4 is typically engaged by an overhead crane, not shown. In use, a free end or nose 15 of the lower leg 14 is inserted into a central circular opening of coiled steel and lifted upwardly by the overhead crane such that an upper surface 16 of the lower leg 14 engages a periphery of the central opening of the coil. When the coil reaches its desired location, this process is reversed to remove the lower leg 14 from the opening.

Figure 3:
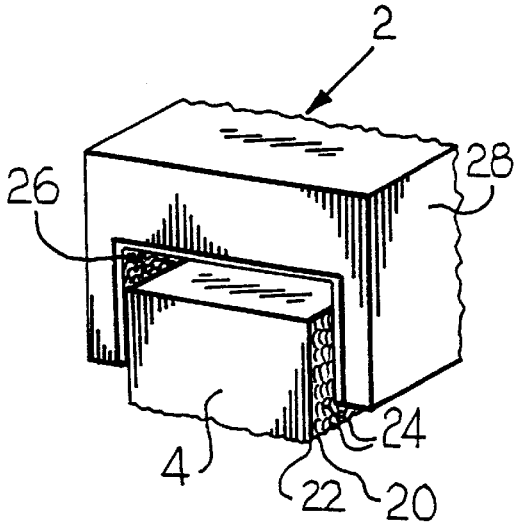
FIG. 3 is a partial perspective, exploded view of one of the protection systems shown in FIG. 1 attached to the C hook.

In one embodiment of the invention, shown in detail in FIG. 3, the coil protector includes an adhering layer 20 fixed to the C hook 4. Although the invention is described for use on a C hook, this is meant to be exemplary only. Other material handling surfaces may readily accept the protection system 2 of the present invention. The adhering layer 20 has a first surface which is attached to the C hook 4 via a conventional adhesive layer 22. A second surface of the adhering layer includes a plurality of hooks 24 extending therefrom. Preferably, the adhering layer 20 is formed from a sheet of a flexible material with the hooks 24 extending from one side of the sheet. Removably attached to the second surface of the adhering layer 20 is a first surface of a connecting layer 26. The connecting layer first surface preferably includes a plurality of loops 27 extending therefrom. The connecting layer 26 preferably is formed from a sheet of flexible material with the loops 27 extending from one side of the sheet. The hooks 24 of the adhering layer 20 removably link with the loops 27 of the connecting layer 26. A preferred adhering layer 20 and a preferred connecting layer 26 are available from Aplix, Inc. as a combination system under product number ML50L00-FE. A second surface of the connecting layer 26 is fixed to a protective layer 28. The protective layer 28 is preferably formed of polyurethane and may be formed in a U-shape for surrounding portions of the C hook 4. For most uses of the protection system 2, the protective layer 28 preferably is ⅝ inch thick. In certain locations on the C hook 4, a thicker protective layer 28 may be necessary. For example, at the nose 15 of the lower horizontal leg 14, the protective layer 28 may be about 1¼ inches thick. The U-shaped protective layer 28 shown in FIG. 3 includes a planar portion connected to a pair of opposing legs. The dimensions of these respective parts of the protective layer 28 may be selected as needed for the particular intended use.

A process for attaching the protective layer 28 to the connecting layer 26 is as follows. The connecting layer 26 preferably is releasably attached to a surface of a die, preferably in the form of a U-shaped block. The die is placed into a bath containing molten polyurethane. The polyurethane is allowed to harden such that the connecting layer 26 fixes thereto. The die is released from the connecting layer 26 resulting in a U-shaped protective layer 28 made of polyurethane having a connecting layer 26 fixed to an inner surface of the U-shaped protective layer 28.

As shown in FIG. 1, the adhering layer 20 may be attached to the C hook 4 in a variety of locations. Such locations include the front surface 8 and side surfaces 10 of the vertical portion 6, the elbow between the vertical portion 6 and the lower horizontal leg 14, the nose 15 and along the underside of the lower horizontal leg 14, as well as on the counterweight 13. The connecting layer 20 may cover a larger surface area of the C hook than the protective layer 28. Preferably, as shown in FIG. 2, only the side surfaces 10 of the vertical portion 6 are covered with the adhering layer 20. The front surface 8 of the C hook 4 is not covered with the adhering layer 20 so that the protective layer 28 is readily removable from the C hook 4. When the front surface 8 of the C hook vertical portion 6 along with the side surfaces 10 thereof are covered with the connecting layer 20, it sometimes becomes difficult to remove the protective layer 28.

In use, the adhering layer 20 is attached to the C hook 4 or other material handling surface by applying an adhesive to the adhering layer 20 or to the C hook 4 and pressing the two components together until the adhesive sets to form the adhesive layer 22, thereby fixing the adhering layer 20 to the C hook 4. A U-shaped or other configuration of the protective layer 28 with connecting layer 26 fixed thereto is placed onto the adhering layer 20. In the preferred embodiment, the hooks 24 of the adhering layer 20 releasably engage the loops 27 of the connecting layer 26. After the protective system 2 is used for a period of time, the protective layer 28 becomes worn. The protective layer 28, along with the connecting layer 26, is pulled away from the adhering layer 20 which remains fixed to the C hook 4. A new protective layer 28 with connecting layer 26 is then removably placed on the existing connecting layer 20. This process can be repeated many times as needed. The C hook 4 does not need to be removed from the steel mill to replace the protection system 2 and a minimal amount of labor is required. In addition, there are no metal components, such as bolts, in the protection system 2 which could damage the goods handled by the C hook 4 upon wearing away of the protective layer 28.

Figure 4:
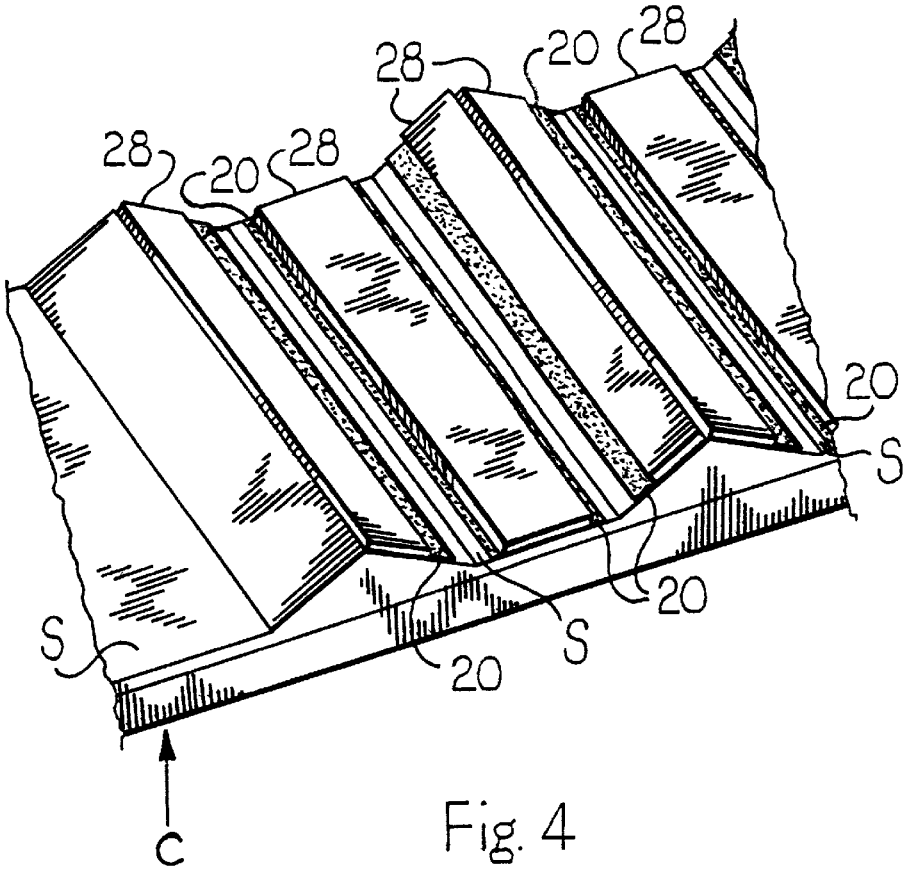
FIG. 4 is a partial perspective view of the protection system attached to a train seat of a transfer car.
Figure 5:
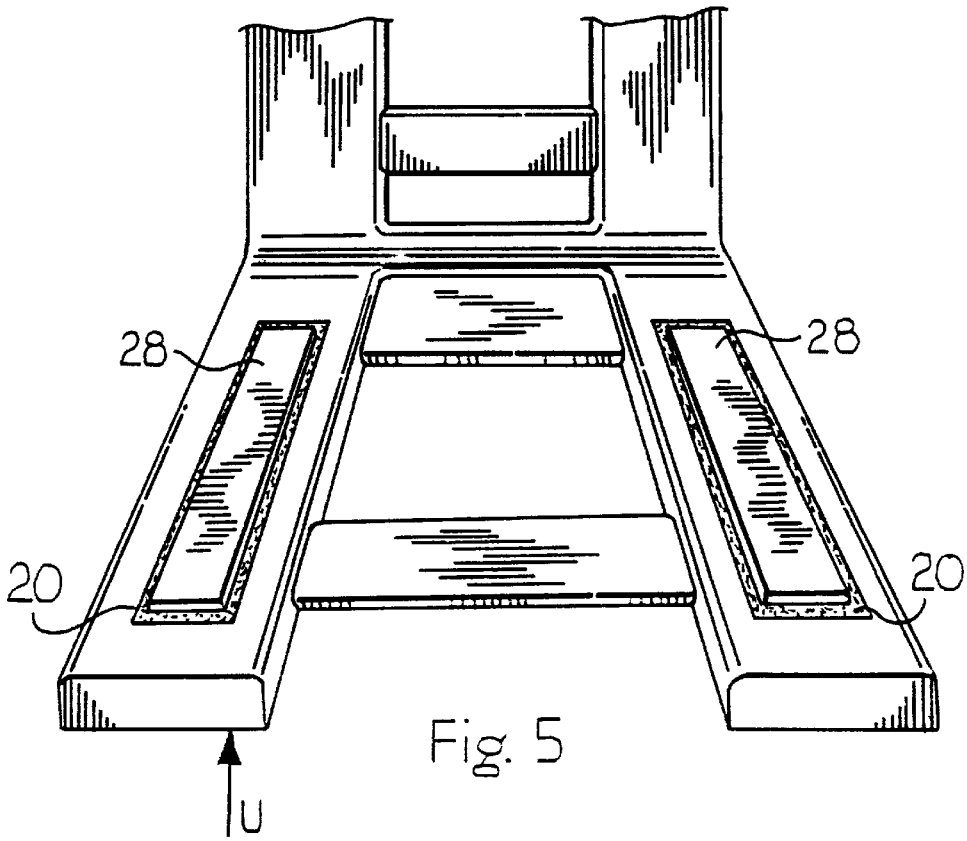
FIG. 5 is a partial perspective view of the protection system attached to an up-ender unit.

Although the protective layer 28 is disclosed as being useful on a C hook 4, a variety of other surfaces of material handling components may accommodate the protection system 2. In the context of a steel mill, such other surfaces include the train seats S of a transfer car C (FIG. 4) and the exposed surfaces of an up-ender U (FIG. 5) used to change the orientation of a coil from vertical to horizontal. In addition, surfaces across which materials are slid such as tables and the like may also be protected by the protection system of the present invention.

Figure 6:
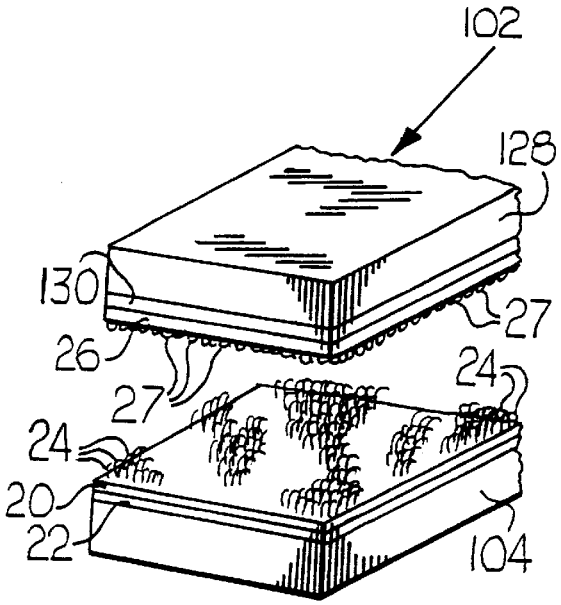
FIG. 6 is a perspective view of a portion of an alternative embodiment of the coil protection system.

In particular, a second embodiment of the invention shown in FIG. 6 may be used for sliding surfaces. The surface protection system 102 shown in FIG. 6 is similar to the protection system 2 depicted in FIG. 3, however, it is preferably provided in a substantially planar form as opposed to a U-shaped configuration. The adhering layer 20 with hooks 24 is fixed to a sliding surface 104 (such as a table, chute or the like) via the adhesive layer 22 in the same manner as the adhering layer 20 is fixed to a C hook 4. The contacting layer 26 is likewise removably attached to the adhering layer 20. For sliding surfaces it is often desirable to use an ultrahigh molecular weight (UHMW) plastic as a protective layer 128 instead of the polyurethane preferably used to form the protective layer 28. UHMW plastics provide a lower coefficient of friction between the protective layer 128 and the materials to be slid across it than does a layer of polyurethane. Suitable UHMW plastics are available from Poly-Hi Solidar Company of Delmont, Pa. However, it has been found that the protective layer 128 formed from UHMW plastic often is difficult to fix to the connecting layer 26, particularly when made from a sheet material having loops thereon. To fix the UHMW to the loop-bearing sheet material, a joining layer 130 of rubber (natural or synthetic) or fabric may be disposed therebetween. FIG. 6 depicts the joining layer 130 sandwiched between the protective layer 128 and the connecting layer 26. When formed from rubber, the joining layer 130 is preferably about 1/16 inch thick. The sandwiched arrangement preferably is made by first fixing the connecting layer 26 to the joining layer 130 with a conventional adhesive. Molten UHMW plastic is poured onto the joining layer 130 and hardens thereon to produce the protective layer 128.

Although the present invention has been described with respect to two embodiments having specific geometrical configurations, other configurations of protection systems having a removable protective layer fixed to a connecting layer, the connecting layer being removably attached to an adhering layer fixed to the material handling surface are also encompassed by the present invention. In addition, the present invention is useful in a variety of material handling situations including the wear plates and chutes in coal, salt and granite mines and the material handling components in pipe and tubing production facilities, particularly for production of critical surface tubing such as stainless steel tubing used in exercise equipment and the like.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

I claim:

1. A surface protection system for covering a materials handling component with a protective element to prevent damage between a material and the component comprising:

an adhering layer having a first surface and a second surface, said first surface configured to be fixed to a component;

a connecting layer having a first surface and second surface, said connecting layer first surface being removably attached to said adhering layer second surface; and a protective layer having a first surface and a second surface, said protective layer first surface being fixed to said connecting layer second surface, such that said protective layer maintains the component in spaced apart relationship from a material handled by the component;

wherein said protective layer is a rigid, plastic substrate having said connecting layer integrally formed therewith.

2. The system as claimed in claim 1 wherein said adhering layer second surface includes a plurality of hooks, said connecting layer first surface being removably attached to said adhering layer second surface via said hooks.

3. The system as claimed in claim 2 wherein said connecting layer first surface includes a plurality of loops, said hooks being configured to engage said loops.

4. The system as claimed in claim 1 wherein said rigid, plastic substrate is polyurethane or an ultrahigh molecular weight polymer.

5. The system as claimed in claim 1 wherein said rigid, plastic substrate is an ultrahigh molecular weight polymer and wherein said system further comprises a joining layer integrally formed with and between said connecting layer and said protective layer.

6. The system as claimed in claim 5 wherein said joining layer is formed from rubber or fabric.

7. The system as claimed in claim 1 wherein said protective layer is planar.

8. The system as claimed in claim 1 wherein said protective layer is formed in a U-shaped configuration and includes a planar portion having a pair of integral leg portions, said leg portions positioned on opposing sides of said planar portion.

9. A method of protecting a material subject to damage from a material handling component comprising the steps of:

providing a material handling component;

fixing a first surface of an adhering layer to the material handling component; and removably attaching a first surface of a connecting layer to a second surface of the adhering layer, a second surface of the connecting layer integrally formed with a protective layer, such that the protective layer maintains a material to be handled and the material handling component in spaced apart relationship and protects the material from damage by the material handling component.

10. The method as claimed in claim 9 wherein said step of fixing an adhering layer first surface comprises disposing an adhesive layer between the material handling component and the adhering layer first surface.

11. The method as claimed in claim 10 wherein the adhering layer second surface includes a plurality of hooks and wherein said step of removably attaching the connecting layer first surface comprises releasably engaging the hooks of the adhering layer second surface with the connecting layer first surface.

12. The method as claimed in claim 11 wherein the connecting layer first surface includes a plurality of loops and said step of removably attaching the connecting layer first surface comprises releasably engaging the hooks of the adhering layer second surface with the loops of the connecting layer first surface.

13. The method as claimed in claim 12 wherein the protective layer is a rigid, plastic substrate.

* * * * *